US010369760B2

(12) United States Patent
Wetsch et al.

(10) Patent No.: US 10,369,760 B2
(45) Date of Patent: Aug. 6, 2019

(54) PROTECTIVE PACKAGING DEVICE VARIABLE SUPPORT

(71) Applicant: PREGIS INNOVATIVE PACKAGING LLC, Deerfield, IL (US)

(72) Inventors: Thomas D. Wetsch, St. Charles, IL (US); Paul F. Ostwald, Queensbury, NY (US); William James Watts, Tinley Park, IL (US)

(73) Assignee: PREGIS INNOVATIVE PACKAGING LLC, Deerfield, IL (US)

( * ) Notice: Subject to any disclaimer, the term of this patent is extended or adjusted under 35 U.S.C. 154(b) by 38 days.

(21) Appl. No.: 15/479,905

(22) Filed: Apr. 5, 2017

(65) Prior Publication Data

US 2017/0282480 A1 Oct. 5, 2017

Related U.S. Application Data

(60) Provisional application No. 62/318,567, filed on Apr. 5, 2016.

(51) Int. Cl.
*B31D 5/00* (2017.01)

(52) U.S. Cl.
CPC ..... *B31D 5/0073* (2013.01)

(58) Field of Classification Search
CPC .. B31D 5/0073; B65H 49/205; B65H 49/305; B65H 49/325
See application file for complete search history.

(56) References Cited

U.S. PATENT DOCUMENTS

| | | | | |
|---|---|---|---|---|
| 4,143,829 | A * | 3/1979 | Martin | B65H 75/08 242/571.6 |
| 4,196,866 | A | 4/1980 | Schaffner et al. | |
| 5,263,854 | A | 11/1993 | Bradshaw | |
| 6,003,288 | A | 12/1999 | Sperry et al. | |
| 8,128,770 | B2 | 3/2012 | Wetsch et al. | |
| 2013/0053767 | A1 | 2/2013 | Pivonka et al. | |
| 2016/0060060 | A1 | 3/2016 | Macura et al. | |

(Continued)

OTHER PUBLICATIONS

International Search Report & Written Opinion dated Jul. 3, 2017 in PCT/US2017/02610, 10 pages.

*Primary Examiner* — Sang K Kim
(74) *Attorney, Agent, or Firm* — Dorsey & Whitney LLP

(57) ABSTRACT

Provided is a protective packaging formation device for sealing a flexible web. The device includes a housing having multiple housing supports disposed to collectively define different support plane areas for contact with an underlying surface. The housing is positionable in a multiple different dispensing orientations by placing the housing in different housing supports. The device also includes a web support depending from the housing. The web support includes a one end positioned distally from the housing and a second end positioned proximal to the housing. The web support supports a supply of a flexible web in a position extending from the housing beyond the housing support. The device also includes an adjustable stand connected to one end of the web support and extending down to the underlying surface such that the stand limits the tilting of the housing in the direction in which the web support extends from the housing.

24 Claims, 8 Drawing Sheets

(56) References Cited

U.S. PATENT DOCUMENTS

| | | | | |
|---|---|---|---|---|
| 2016/0137355 | A1 | 5/2016 | Wetsch et al. | |
| 2017/0275036 | A1* | 9/2017 | Wetsch | B65B 61/06 |
| 2017/0282479 | A1* | 10/2017 | Wetsch | B31D 5/0073 |

* cited by examiner

PROTECTIVE PACKAGING DEVICE VARIABLE SUPPORT

CROSS REFERENCE TO RELATED APPLICATIONS

This application claims priority to U.S. Application No. 62/318,567 filed Apr. 5, 2016, the content of which is incorporated in reference in its entirety.

TECHNICAL FIELD

The present disclosure relates to packaging materials. More particularly, the present disclosure is directed to devices and methods for manufacturing inflatable cushions to be used as packaging material.

BACKGROUND

A variety of inflated cushions are well known and used for sundry packaging applications. For example, inflated cushions are often used as void-fill packaging in a manner similar to or in place of foam peanuts, crumpled paper, and similar products. Also for example, inflated cushions are often used as protective packaging in place of molded or extruded packaging components. Generally, inflated cushions are formed from films having two plies that are joined together by seals. The seals can be formed simultaneously with inflation, so as to capture air therein, or prior to inflation to define a film configuration having inflatable chambers. The inflatable chambers can be inflated with air or another gas and thereafter sealed to inhibit or prevent release of the air or gas.

Typically inflation and sealing devices have a single set orientation that allows them to process material in a certain way relative to their support surface. For example, the inflation and sealing devices have material that rolls off of a spindle and then exits the machine in one way, generally parallel to the support surface. Such a construction limits the available locations that the inflation and sealing devices can be used due to obstructions or ergonomics that make single orientation insufficient. These shortcomings also extend to the relationship between the inflation sealing devices and their control interfaces. For example, there are typically two orientations of inflation and sealing devices that are used in the industry. In one orientation the control interface is located perpendicular to the material flow and in the other orientation the control interface is located parallel to material flow. On a perpendicular control interface machine, the controls are facing the operator, right where the material exits the machine. Other machines have the controls parallel to material flow. Unless the machine is on the corner of a table, the controls have inferior accessibility. While material may exit different machines in a verity of manners, each machine is limited to its orientation of processing. As such, it may be desirable to provide a more universal inflation and sealing device with multiple usable orientations.

SUMMARY

In accordance with various embodiments, a protective packaging formation device for sealing a flexible web includes a housing having a plurality of housing supports disposed to collectively define a plurality of support plane areas. Each of the support plane areas is operable for separate contact with an underlying surface, such that the housing is positionable in a plurality of different dispensing orientations by placing the housing on the different housing supports. The protective packaging formation device for sealing a flexible web also includes a web support depending from the housing and having a first end positioned distally from the housing and a second end positioned proximal to the housing such that the web support supports a supply of a flexible web in a position extending from the housing beyond the housing support. The protective packaging formation device for sealing a flexible web also includes an adjustable stand connected to the first end of the web support and extending down to form an additional point in at least one of the plurality of support plane areas, such that the stand operably limits the tilting of the housing in the direction in which the web support extends from the housing.

In accordance with various embodiments, the flexible web support is positioned in a cantilevered position relative to the housing when the housing is positioned in at least one of the plurality of dispensing orientations. In the cantilevered position the weight of the web positioned on the web support tends to tilt the housing in the direction that the web support extends from the housing. The stand includes a foot bracket that extends from the housing in generally the same direction as the web support with at least one support on the distal end of the stand and the at least one support is generally planer with at least one of the plurality of housing supports. The stand extends from the housing between the web support and a base of the housing and the stand is a single beam that is smaller in cross-section than the web support and the web supported thereon. The stand is of a sufficient length to extend from the web support to one of the plurality of support plane areas.

In accordance with various embodiments, the web support includes a spindle and the stand is a spindle support located on the spindle end located distally from the housing. At least one of the web support or the stand includes a bearing that allows movement between web support and the stand. The spindle support is adjustable about an axis such that the spindle support is configurable to extend to different support plane areas under the housing. The spindle support is rotatable relative to the spindle. The rotation is centered on the axis of rotation of the spindle. The spindle is located at a halfway point between the top support and the bottom support such that the rotatable spindle support terminates at each of these respective support plane areas and provides substantially the same support to the spindle at each of these support surfaces.

In accordance with various embodiments, the spindle support is a beam that extends from the first end of the spindle. The beam includes at least one bend that defines an elongated foot that reaches at least one support plane area. The housing includes end walls that form elongated contact surfaces on a base of the housing and a top of the housing, with each of the two elongated surfaces defining two supports of the plurality of supports. The end walls also form elongated contact surfaces on the back of the housing as another support of the plurality of supports. The end walls also form elongated contact surfaces along the front of the housing at the base and the top. A front wall and the end walls of the housing are formed of a single c-shaped sheet of material that forms the bottom support at the front and end walls, top support at the top and end walls, and a back support on the back of the housing where the legs of the c-shaped sheet of material terminate in a support plane area.

In accordance with various embodiments, one or more of the supports includes one or more mounting features for mounting the housing in a vertical position. The mounting features are apertures suitable to receive a fastener and suitable to mount the housing to a vertical support. The one or more mounting features includes at least two mounting features spaced sufficiently far apart to limit the tendency of the housing to tilt in the direction of the spindle due to the cantilevered position of the spindle and its weight.

In accordance with various embodiments, a protective packaging formation device for sealing a flexible web including a repositionable housing having a plurality of housing supports disposed to collectively define a plurality of different support plane areas for contact with an underlying surface, such that the housing is positionable in a plurality of different dispensing orientations resulting from placing the housing on the plurality of different support plane areas. The protective packaging formation device for sealing a flexible web also includes a web support depending from the housing. The web support includes a first end positioned distally from the housing and a second end positioned proximal to the housing such that the web support supports a supply of a flexible web in a position extending from the housing beyond the housing support. The plurality of housing supports allow the web to be dispensed from a driving mechanism on the housing in different positions depending on which of the plurality of different dispensing orientations the housing is positioned in.

DETAILED DESCRIPTION

The present disclosure is related to protective packaging and systems and methods for converting uninflated material into inflated cushions that may be used as cushioning or protection for packaging and shipping goods.

Figure 1:
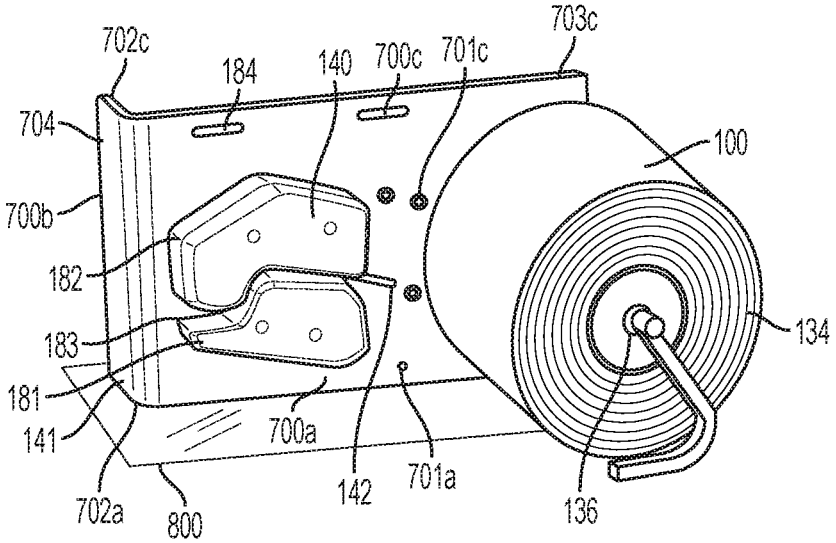
FIG. 1 is a front left perspective view of an of an inflation and sealing device according to one embodiment with the nozzle directed downward.

As shown in FIG. 1, a multi-ply flexible structure 100 for inflatable cushions is provided. In various embodiments, the flexible structure 100 includes a first film ply and a second film ply. The second ply is aligned to be over lapping and can be generally coextensive with the first ply. In some embodiments, the plies can be partially overlapping with inflatable areas in the region of overlap. The first and second plies can be formed from a single sheet of flexible structure 100 material, a flattened tube of flexible structure 100 with one edge has a slit or is open, or two sheets of flexible structure 100. For example, the first and second plies can include a single sheet of flexible structure 100 that is folded to define the joined second edges (e.g., "c-fold film"). Alternatively, for example, the first and second plies can include a tube of flexible structure (e.g., a flatten tube) that is slit along the aligned first longitudinal edges. Also, for example, the first and second plies can include two independent sheets of flexible structure joined, sealed, or otherwise attached together along the aligned second edges.

The flexible structure 100 can be formed from any of a variety of web materials known to those of ordinary skill in the art. Such web materials include, but are not limited to, ethylene vinyl acetates (EVAs), metallocenes, polyethylene resins such as low density polyethylene (LDPE), linear low density polyethylene (LLDPE), and high density polyethylene (HDPE), and blends thereof. Other materials and constructions can be used. The disclosed flexible structure 100 can be rolled on a hollow tube, a solid core, or folded in a fan folded box, or in another desired form for storage and shipment.

The flexible structure 100 includes the transverse seals as well as the sealed longitudinal edges can be formed from any of a variety of techniques known to those of ordinary skill in the art. Such techniques include, but are not limited to, adhesion, friction, welding, fusion, heat sealing, laser sealing, and ultrasonic welding. The sealed compartments can be inflated to form inflatable cushions such as those disclosed in U.S. patent application Ser. No. 14/937,869 hereby incorporated by reference in its entirety. Or they can be formed as other inflatable cushions known in the industry. In some embodiments, the material on the material support could be a paper material being fed into a conversion assembly for crumpling the paper. In other embodiments, the system could be a foam in bag system using different materials. The flexible structure 100 is used herein as an example but it should be appreciated that based on the disclosure herein that these other examples (e.g. paper or foam in bag) in addition to other known systems may likewise be utilized instead of the flexible structure 100 discussed herein.

An inflation and sealing device 132 for converting the flexible structure 100 of uninflated material into a series of inflated pillows or cushions is provided. The uninflated flexible structure 100 can be a supply of material 134 provided on web support 136. The web may be fan folded, delivered in sheets, provided as a roll of material or similar supply techniques. In one example the web support 136 accommodates the center of the roll of web material 134. Alternative structures can be used to support the roll, such as a tray, fixed spindle or multiple rollers.

An inflation region, such as a closed passageway, which can be a longitudinal inflation channel, can be provided. The longitudinal inflation channel is disposed between the second end of the transverse seals and the first longitudinal edge of the film. Preferably, the longitudinal inflation channel extends longitudinally along the longitudinal side and an inflation opening is disposed on at least one end of the longitudinal inflation channel.

Figure 2:
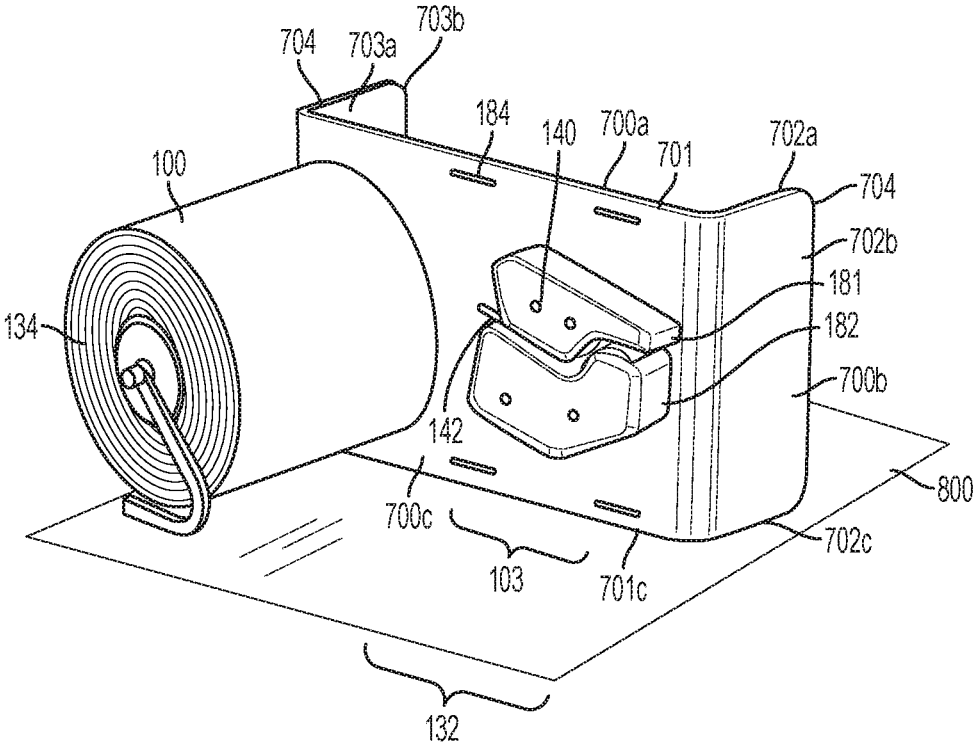
FIG. 2 is a front right perspective view of the inflation and sealing device from FIG. 1 with the nozzle directed upward.
Figure 3:
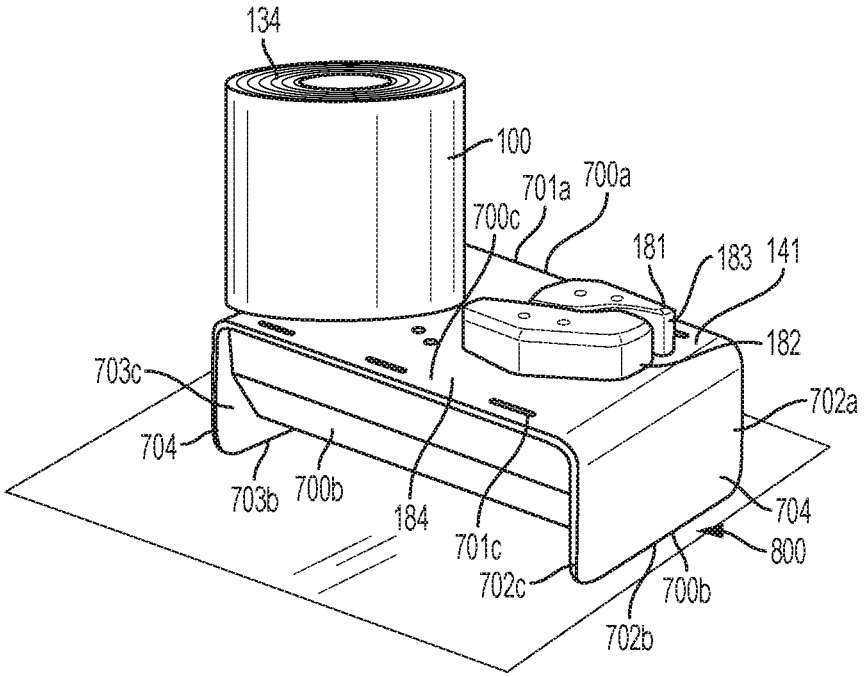
FIG. 3 is a front right perspective view of the inflation and sealing device from FIG. 1 with the inflation and sealing device supported on its back.
Figure 4:
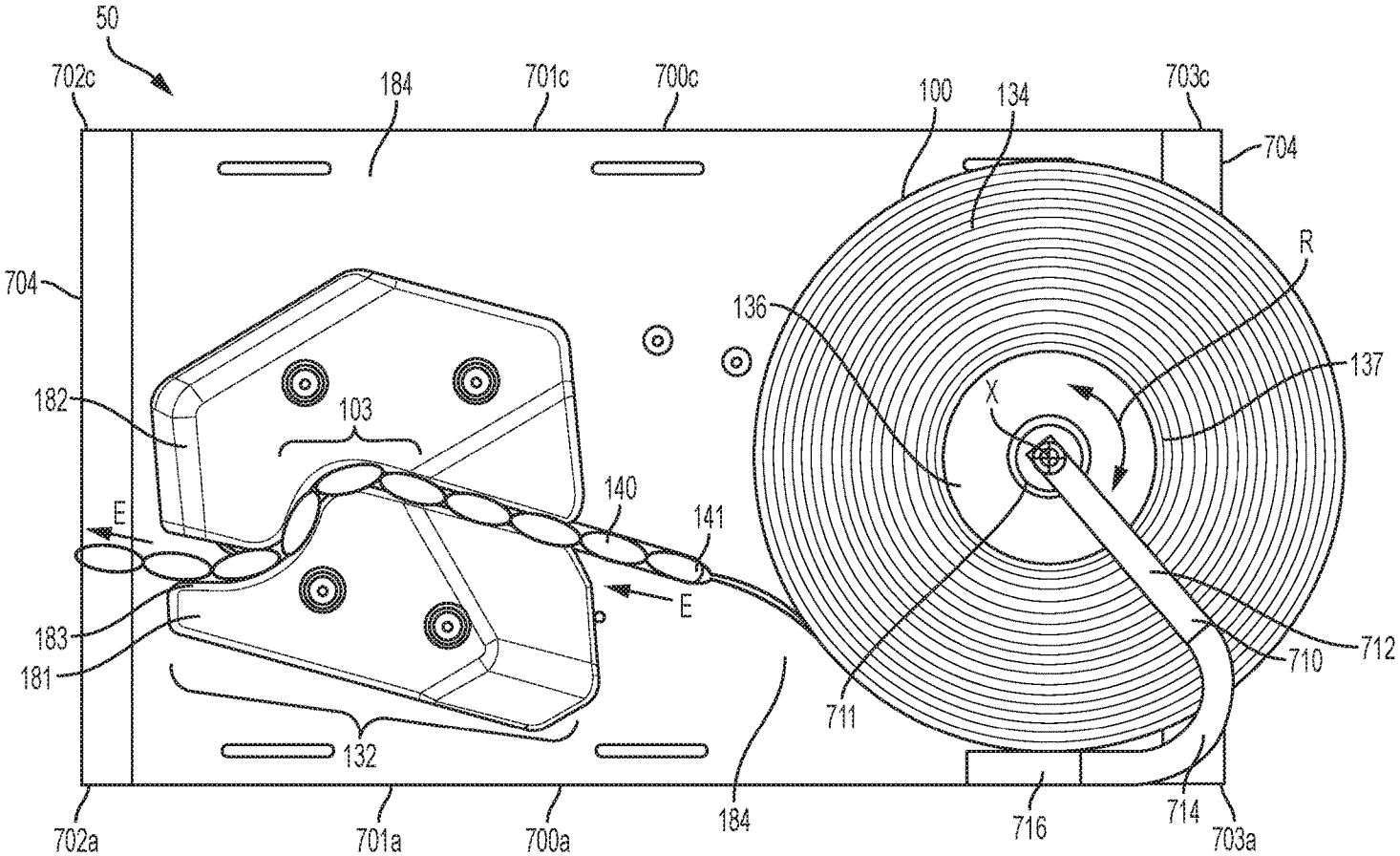
FIG. 4 is a front view of the inflation and sealing device from FIG. 1 with the nozzle directed downward.
Figure 5:
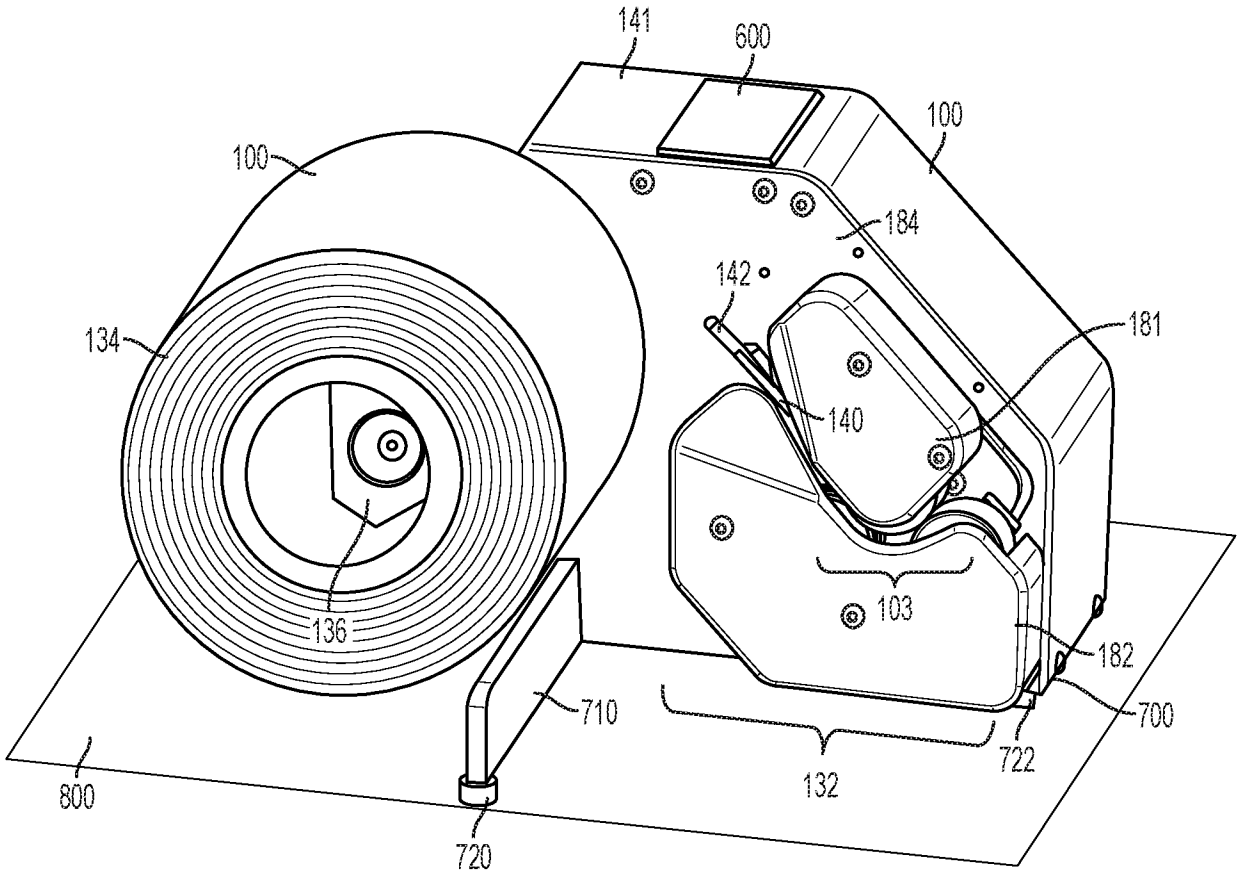
FIG. 5 is a front right perspective view of the inflation and sealing device according to one embodiment.
Figure 6:
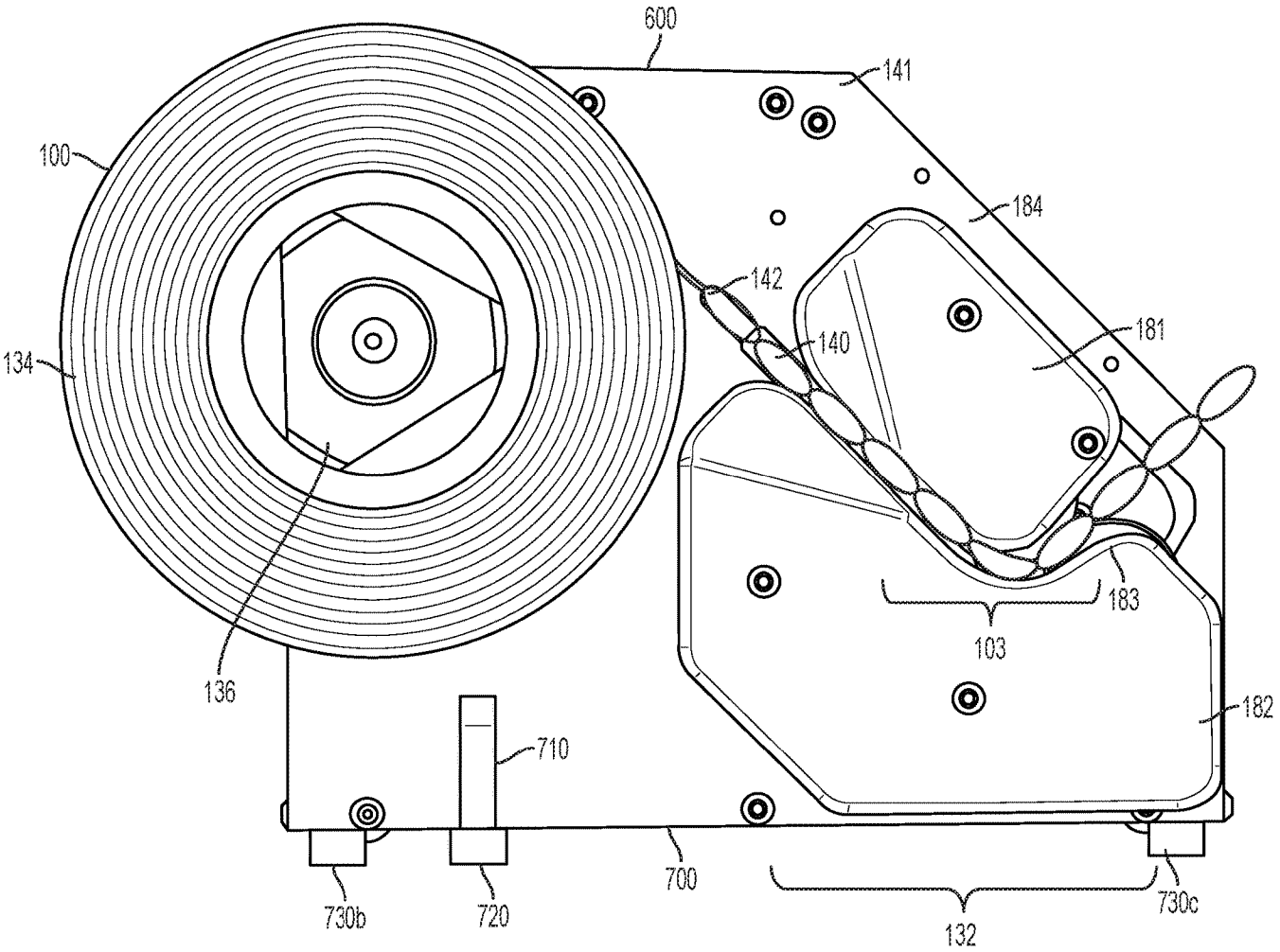
FIG. 6 is a front view of the inflation and sealing device from FIG. 5 in a cantilevered position.
Figure 7:
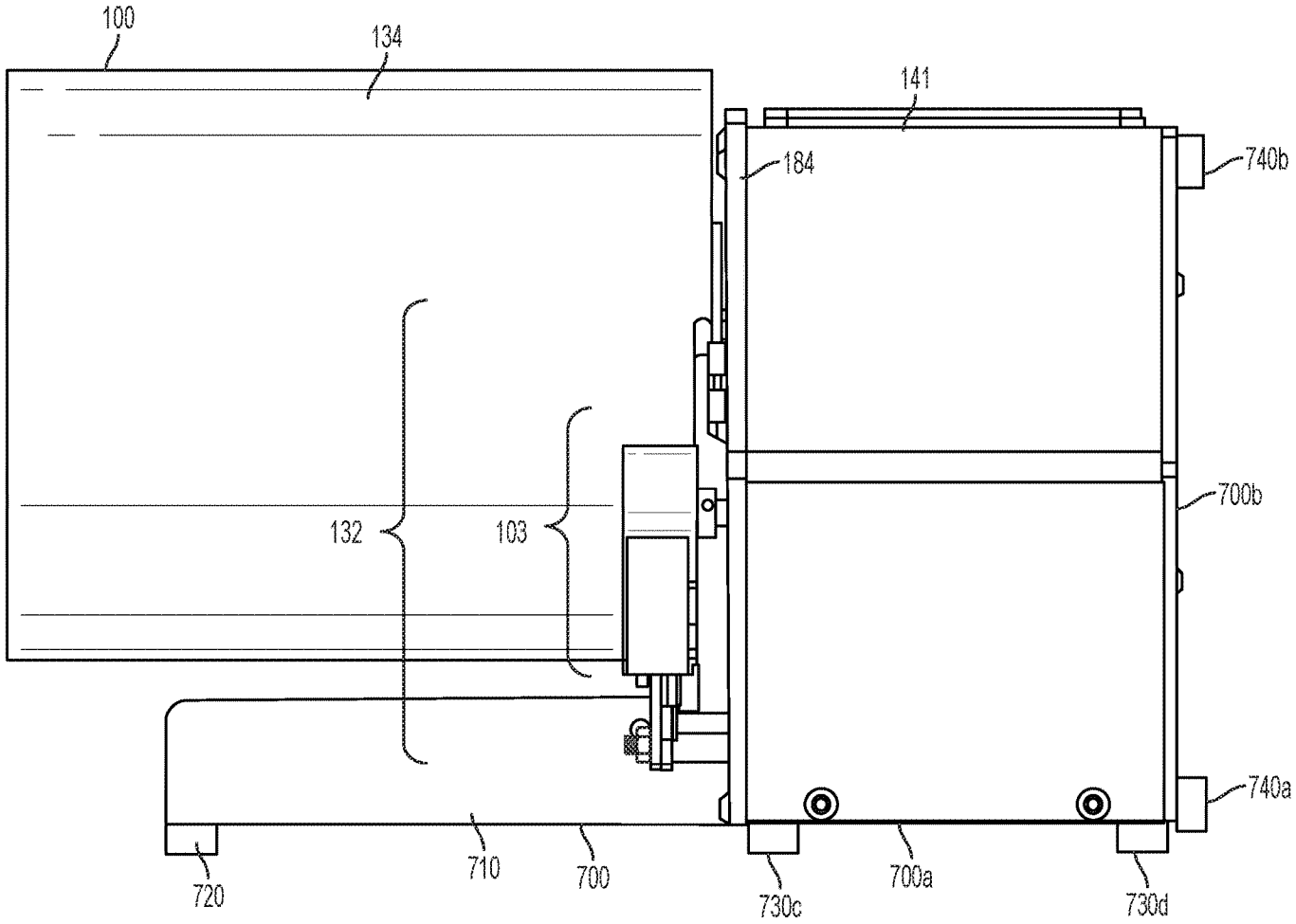
FIG. 7 is a right view of the inflation and sealing device from FIG. 5 in a cantilevered position.
Figure 8:
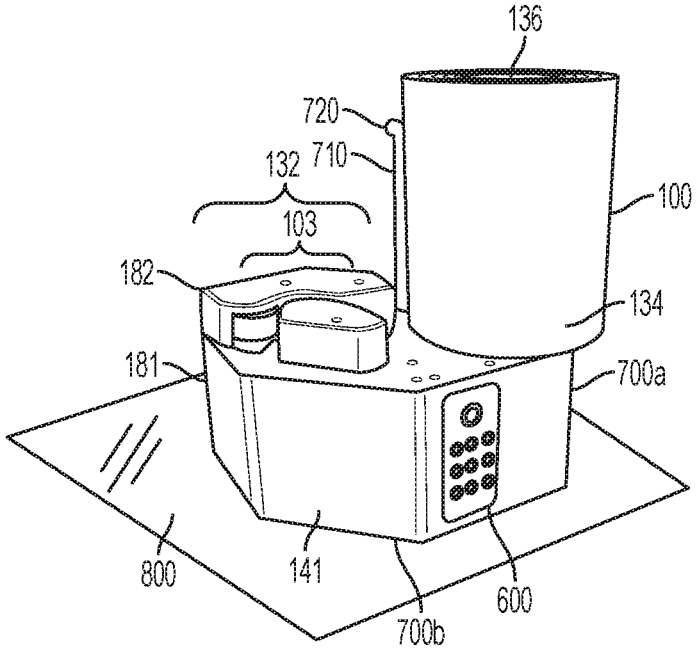
FIG. 8 is a perspective view of the inflation and sealing device from FIG. 5 positioned on a back surface support.

In accordance with various embodiments, a protective packaging formation device 50 for inflating and sealing of the flexible web 100 is provided. The protective packaging formation device includes a housing 141. A web support 136 depends from the housing 141 in at least one direction. In at least one position, the web support 136 may be cantilevered from the housing 141. The protective packaging formation device 50 also includes an inflation and sealing assembly 132. The inflation and sealing assembly 132 is supported by the housing 141. The protective packaging formation device 50 also includes a flexible web support 136 extending out from the housing 141. In accordance with various embodiments, the housing 141 includes different dispensing orientations. By positioning the housing 141 in the different dispensing orientations, the flexible web support 136 extends from the housing 141 in different directions or is processed by the device 50 along the housing in different orientations depending on in which of the variety of different dispensing orientations the housing 141 is positioned. For example, as shown in FIG. 1 the nozzle tip 142 is directed down to receive the web 100 from below the roll 134. In a different orientation, shown in FIG. 2 the nozzle tip 142 is pointed up to receive the web 100 from above the roll 134. In FIG. 3 the housing 141 is on its back and as such the web is processed through the inflation and sealing assembly 132 in a vertical orientation instead of a more horizontal orientation as shown in FIG. 1 and FIG. 2. The nozzles can be pointing in a variety of directions, but these are used to illustrate the different relative orientations based on the orientation of the housing 141.

In various examples, the housing 141 includes supports suitable to suspend the housing 141 on an underlying support (e.g. surface 800). The underlying support can include a surface, bracket, rack or the like. The underlying support 800 is suitable for operation of the packaging formation device and allows a user to extract the inflated cushions from the device 50. The supports can be single points of contact, flat surfaces, curved surfaces or the like suitable to provide the device 50 structural stability on the underlying support 800. The supports or a group of supports contact the support surfaces at points of contact. The points of contact define a plane, which is herein referred to as a support plane. The support surfaces, such as underlying support 800, tend to be planar. The support on the device 50 is suitable to contact planar support surface, and thus the points of contact that make up the support define a support plane. The support plane, however, has a limited area, as limited by that area within the contact points of the support. Thus, the various groups of supports discussed herein define areas of support planes, which are referred to herein as support plane areas. The housing 141 can be positioned in a variety of different dispensing orientations, extending in different support planes, by placing the housing 141 on the different supports in the plurality of supports.

In one example, as illustrated in FIGS. 1-4, the device 50 includes a first support 700*a* that extends in a first support plane. The first support 700*a* is generally positioned on one side of the device 50, such as the base of the machine. As shown, for example in FIGS. 1-4, the first support 700*a* can be a surface that is of suitable size and geometry configured to provide stability to the device 50. In a preferred example, the surface 700*a* defines an edge of the housing 141. In some embodiments, the first support 700*a* is a planar edge that is substantially continuous in the first support plane.

The device 50 includes a second support 700*c* that extends in a second support plane. The second support 700*c* is generally positioned on another side of the device 50, such as the top of the machine. For example, the second support plane can extend substantially parallel to the first support plane. The surface 700*c* is of suitable size and geometry configured to provide stability to the device 50. In a preferred example, the surface 700*c* defines an edge of the housing 141. In some embodiments, the second support 700*c* is a planar edge that is substantially continuous along the second support plane.

The device 50 includes a third support 700*b* that defines a third support plane. The third support 700*b* is generally positioned on another side of the device 50, such as the back of the machine. For example, the third support plane can extend substantially perpendicular to the first and second support planes. The surface 700*b* is of suitable size and geometry configured to provide stability to the device 50. In a preferred example, the surface 700*b* defines two edges of the housing 141. For example, the third support 700*b* can comprise two edges that extend between the first and second supports 700*a*, 700*c*. In some embodiments, the third support 700*b* extends to meets the first and second supports 700*a*, 700*c* at perpendicular angles.

In the example, as illustrated, the supports 700*a*, 700*b*, and 700*c* are formed by a housing having a front wall 184 and the end walls 704. The front wall 184 and end walls 704 are formed of a single c-shaped sheet of material. While in a preferred embodiment metal is used, other suitable materials may also be used such as polymers, composites, or like materials. The c-shaped sheet of material forms the bottom support 700*a* at the front and end walls, top support 700*c* at the top and end walls, and a back support 700*b* on the back of the housing 141 where the legs 704 of the c-shaped sheet of material terminate in a support plane area defining surface 702*b*. Other suitable shapes and sizes of housing 141 may also be used such that the housing 141 includes different support plane areas defined by one or more supports (e.g. 700*a*, 700*b*, or 700*c*) for contact with an underlying support (e.g. surface 800) such that the housing can be positioned in a plurality of different dispensing orientations. Other examples of shapes could include L-shaped sheet material, boxes, or similar.

In accordance with various examples, as illustrated in FIGS. 1-10, the device 50 includes a first support surface 700. The support surface 700 may be a primary support surface. The primary support may be a base support 700*a* that positions the device 50 in an upright position with the web support 136 extending in a cantilevered position, out and away from the housing 141. A second support, such as support 700*b*, positions the device 50 in a prone position (i.e., on a back of the device) with the web support 136 extending upwardly from the housing 141. In accordance with one example, as illustrated in FIGS. 5-10, the base support 700*a* may include one or more secondary supports such as standoffs. In particular, the base support 700*a* may include standoffs 730*a-d* configured to provide stability, traction, and/or vibration isolation between the device 50 and the underlying support surface 80. In various examples, the back support 700*b* may include standoffs 740*a-d* configured to provide stability, traction, and/or vibration isolation between the device 50 and the underlying support surface 80.

Figure 9:
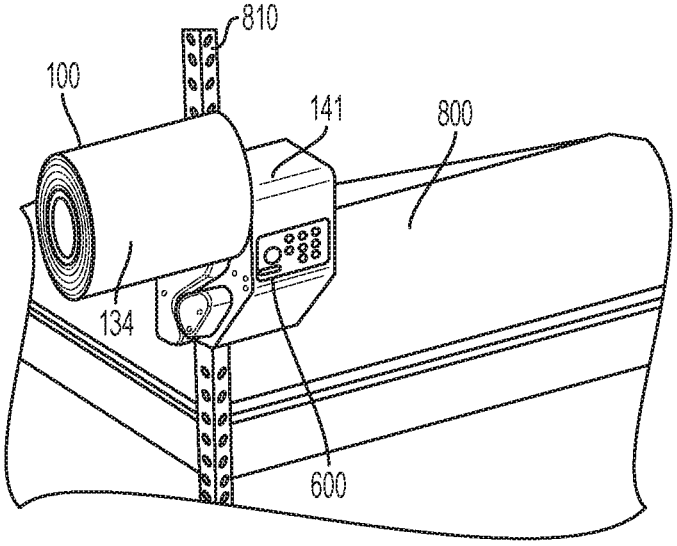
FIG. 9 is a front perspective view of the inflation and sealing device from FIG. 5 positioned on a bracket support in the vertical position.
Figure 10:
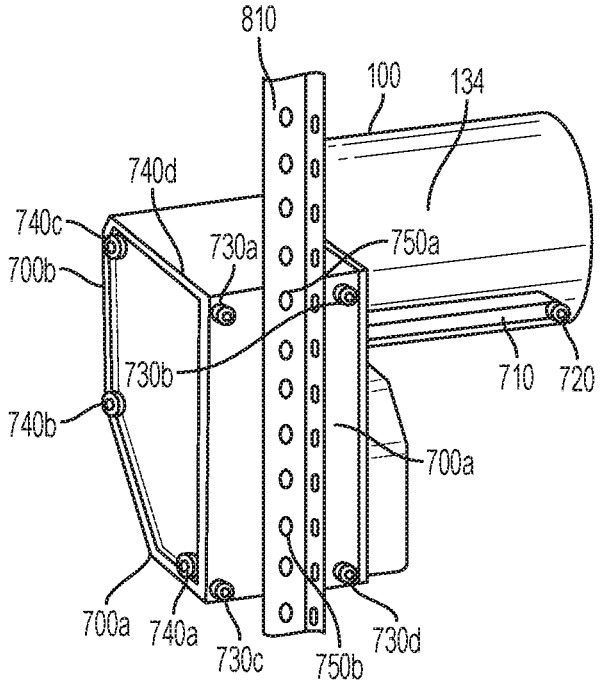
FIG. 10 is a back perspective view of the inflation and sealing device from FIG. 5 positioned on a bracket support in the vertical position.

As indicated above, in some instances the support is not a surface but is a bracket such as bracket 810 shown in FIGS. 9 and 10. In such an embodiment, one or more of the sides of the device 50 may include attachment points to connect the device 50 to the bracket 810. For example, the device 50 may include apertures 750*a* and/or 750*b*. While these apertures are shown with respect to support surface 700*a*, they could also or alternatively be located on one of the other sides of device 50, such as support 700*b*. Thus, the one or more of the supports (e.g. 700*a* or 700*b*) may include one or more mounting features 750*a* or 750*b* for mounting the housing 141. This mounting may be in a vertical position, as shown by way of example in FIGS. 9 and 10, or this mounting may be in a horizontal or other position suitable to simplify the processing of the cushion formations for the user by, for example, improving the ergonomics. The mounting features 750*a* or 750*b* in the illustrated example are apertures suitable to receive a fastener and suitable to mount the housing to a vertical support 810. The mounting features could also be used in addition to the apertures or in the alternative to the apertures. Other mounting features include features formed on the housing 141 such as hooks, studs, or similar for mounting to a bracket, or other hardware (e.g. rivets, snap features, ties, screws, bolts, or the like) suitable to make the connection. The one or more mounting features 750*a* or 750*b* are spaced sufficiently far apart to limit the tendency of the housing 141 to tilt in the direction of the web support 136 due to the cantilevered position of the web support 136 and its weight due to the rolled flexible web 134.

In accordance with various embodiments, the web support 136 includes a first end positioned distally from the housing 141 and a second end positioned proximal to the housing 141. The web support 136 supports the supply of a flexible web 100 in a position extending from the housing 141 beyond the housing support 700 when in a cantilevered position. In a housing position when the housing is supported by a back support 700*b*, the web support 136 may extend upwardly from the housing 141. In accordance with various embodiments, as illustrated in FIGS. 1-4, an adjustable stand 710 may be connected to one end of the web support 136. The stand 710 extends down to the underlying surface 800 such that the stand 710 limits the tilting of the housing 141 in the direction in which the web support 136 extends from the housing. As indicated above, the weight of the web support 136 and/or the supported flexible web 134 tends to cause the housing 141 to tilt in the direction of the cantilevered web support 136 during use of the device 50.

As indicated above, the support such as support 700*a* defines a support for the device 50. The support 700*a* may only provide a portion of the support that works in conjunction with the support provided by stand 710. Support 700*a* and stand 710 form a tripod to keep the device 50 stable during operation. In some examples, the support 700*a* may in some instances be stable alone; thus, the stand 710 may shore up this stability by creating the tripod shape such that the device 50 has increased stability in operation or out of operation. In other examples, the support 700*a* relies on the stand 710 to provide stability in operation or out of operation. In either event, the stand 710 defines at least one point on the support plane area and limits the tendency of the web support from tilting the housing. While the housing may define a support plane area with the housing supports, the stand 710 enlarges that support plane area and expands the support plane area out under the web support to provide improved support.

In accordance with various embodiments, the stand 710 is of a sufficient length to extend from the web support 136 to a plurality of the support plane areas such as one or more of the support plane areas defined by the housing support 700*a* or 700*c* or others. In such embodiments, the stand may be adjustable in length or adjustable in position such that the stand can reach one or more support plane areas when the housing is in a cantilevered position.

In accordance with various embodiments, the stand 710 is adjustable in position. In one example, the stand 710 is adjustable from providing support (i.e., reaching the support plane area) when the device 50 is positioned on the base support 700*a* and also adjustable such that the stand 710 also provides support when the device 50 is positioned on the top support 700*b*. In one example, the stand 710 may be rotated to the new position. In another example, the stand 710 may be slidable attached to the web support 136 such that it can be adjusted between the two positions. Any movement or adjustment suitable to provide support in more than one orientation of the device 50 is contemplated herein.

In accordance with particular embodiments, the web support 136 is a spindle. In other embodiments, the web support 136 is a shelf or a fan-fold box or other structure suitable to support and allow device 50 to withdraw the web from the supply 134. In embodiments in which the web support 136 is a spindle, the stand 710 is a spindle support located on the spindle end distally from the housing. In various examples and shown in FIGS. 1-4, the spindle support 710 is adjustable. For example, the adjustment is made by rotating the support 710 about an axis X. This rotation allows the spindle support 710 to be configurable to extend to different support plane areas under the housing 141. For example, the support 710 can rotate from 700*a* around to 700*c* such that the housing can be placed on 700*a* or on 700*c* and still benefit from the support 710 in either dispensing orientations. Specifically, in some examples, the stand 710 is rotatable relative to the spindle 136. The axis X can be centered on the axis of rotation of the spindle, allowing the stand 710 to rotate around the same axis as the spindle. Although it should be noted that in other examples and embodiments, the web support 136 may not rotate at all. Even some spindle embodiments may not be rotated.

While illustrated as being aligned with the X axis in the various drawings, it should be noted that the stand 710 can connect to any feature of the housing, web support, or the like such that the support plane area extends out under the web support. For example, the stand 710 can connect to a roll core which slides the roll of material onto or over a spindle as shown in FIGS. 1-4. In this way, there is no direct connection between the stand and the spindle, but together the spindle and the roll core make up the web support 136. In some embodiments, the stand can include a bearing 711 that attaches to the roll core 137 or the spindle giving the stand greater freedom of adjustability and allowing the roll of material 134 to easily rotate and dispense material relative to the stand. The bearing includes any type of bearing device such as a bushings, roller bearings, or the like.

In accordance with particular embodiments, the stand 710 can be any element suitable to stabilize the web support 136 and limit it from tending to tilt the housing 141. The stand 710 can be defined by a beam that extends from the first end of the spindle to a support plane area. In some examples, the beam includes at least one bend 714 that defines an elongated foot 716 that reaches at least one support plane area. The foot 716 can add additional stability to the stand 710 and improve operation of the machine. However, in other examples, the stand can be any shape including a linear beam, a triangle, a block, a circle, or the like shape that provides end support to the web support and limits the tilting of the housing caused by the web support.

In accordance with various embodiments, the stand is connected to the web support or device 50 such that it can be adjusted to contact a support plane area regardless of which direction the housing 141 is oriented. The exception to this may be when the housing 141 is located on its back, such as on support 700*b*. In top, bottom, or side orientations, the stand 710 may be positioned or otherwise adjustable to contact a surface or underlying support 800 such that the stand 710 supports the web support 136. For example, the stand 710 is positioned at a halfway point between the top support 700*c* and the bottom support 700*a* such that the rotatable stand 710 rotates between the two planes in the direction R (see FIG. 2). This enables the foot 716 or its equivalent to terminate at the support plane areas defined by each of these respective supports 700*a* and 700*c*. With this adjustability, the stand 710 provides substantially the same support to the spindle at each of these support surfaces. Other supports can also be supported by the stand 710. For example, in examples wherein side surface 704 is a support surface, the stand may likewise be adjustable to support the web support 136 from such surfaces.

In another example as illustrated in FIGS. 5-10, the stand 710 may be fixed but provide cantilevered support to the web support 136. For example, the stand 710 may include an outrigger foot bracket 710 that extends from the housing 141. More particularly, the foot bracket 710 may extend from front plate 184. The foot bracket 710 extends in generally the same direction as the web support 136. The foot bracket 710 may include at least one standoff 720 on the distal end of the foot bracket. The standoff 720 may make the foot bracket 710 generally planer with at least one of the plurality of housing standoffs (e.g. 730*a-d*). In accordance with various embodiments, the stand 710 extends from the housing 141 between the web support 136 and a base support 700*a* of the housing 141. The stand 710 can be a single beam that is smaller in cross-section than the web support 136 or the web 134 supported thereon. This low profile cross-section may limit any interference that might result due to the presence of the stand 710, such as when the device is mounted in a vertical position as shown in FIG. 10.

In accordance with various embodiments, the protective packaging formation device 50 includes an inflation and sealing assembly 132. The inflation and sealing assembly 132 is supported by the housing and configured for directing a fluid in between first and second overlapping film plies of the flexible web and sealing the fluid therein. The inflation and sealing assembly 132 includes an inflation mechanism having a fluid conduit configured for directing a fluid in between the plies to form one or more cushions. The inflation and sealing assembly 132 includes a sealing mechanism that seals the first and second plies together. The inflation and sealing assembly 132 includes a driving mechanism that moves the web through the device 50.

As discussed above, the housing 141 can be positioned in a variety of orientations extending in different support planes. In each of these various orientations, the flexible structure 100 is pulled by a drive mechanism forming a part of the inflation and sealing assembly 132. In some embodiments, intermediate members such as guide rollers can be positioned between roll 134 and the drive mechanism. For example, the optional guide roller can extend generally perpendicularly from a housing 141. The guide roller can be positioned to guide the flexible structure 100 away from the roll of material 134 and along a material path "B" along which the material is processed. The web is directed onto an inflation nozzle 140 from the supply 134 (e.g. the roll of material). In various embodiments, the stock material may advance downstream from the stock roll of material 134 without engaging a guide roll, but may instead be advanced directly into an inflation and sealing assembly 132.

To prevent or inhibit bunching up of the web material 100 as it is unwound from the roll 134, the roll axle 136 can be provided with a brake to prevent or inhibit free unwinding of the roll 134 and to assure that the roll 134 is unwound at a steady and controlled rate. The web 100 may be directed to and fed onto an inflation nozzle tip forming a part of an inflation nozzle 140. Preferably, the flexible structure 100 is advanced over the inflation nozzle 140 with the chambers extending transversely with respect to the inflation nozzle 140. The inflated flexible structure 100 is then sealed by the sealing assembly 103 to form a chain of inflated pillows or cushions. The inflation and sealing assembly 132 is configured for continuous inflation of the flexible structure 100 as it is unraveled from the roll 134. The roll 134, preferably, comprises a plurality of chain of chambers that are arranged in series.

The techniques and disclosures provided herein may apply to different systems used to inflate and seal flexible web materials. The flow rate of the fluid through the nozzle 140 is typically about 2 to 15 cfm, with an exemplary embodiment of about 3 to 5 cfm. The exemplary embodiment is with a blower 700 rated at approximately 14-20 cfm. But much higher blow rates can be used, for example, when a higher flow rate fluid source is used, such as a blower 700 with a flow rate 1100 cfm. The fluid source can be disposed behind a housing plate 184 or other structural support for the nozzle and sealing assemblies, and behind the inflation nozzle 140.

The flexible structure 100 is advanced or driven through the inflation and sealing assembly 132 by a drive mechanism. The drive mechanism includes one or more devices operable to motivate the flexible structure through the system. For example, the drive mechanism includes one or more motor-driven rollers operable to drive the flexible material 100 in a downstream direction along a material path "E". One or more of the rollers, belts, or drums are connected to the drive motor such that the one or more rollers drive the system. In accordance with various embodiments, the drive mechanism drives the flexible structure 100 without a belt contacting the flexible structure. In one example, the entire system is beltless. In another example, the system has a belt on drive elements that do not come into contact with the flexible structure 100. In another example, the system has a belt on some drive elements but not others. In other example, the system may have belts interwoven throughout the rollers allowing the material to be driven through the system by the belts.

In each of these systems for drive mechanisms, the sealing assembly 132 also includes a heating assembly operable to seal the different layers of the flexible structure 100 to one another. In various embodiments, the heating assembly 400 is positioned transversely between the nozzle 140 and the chambers 120 being inflated to seal across each of the transverse seals. Some embodiments can have a central inflation channel, in which case a second sealing assembly and inflation outlet may be provided on the opposite side of the nozzle. Other known placement of the web and lateral positioning of the inflation nozzle and sealing assembly can also be used. While the various embodiments and examples discussed herein are directed to a heating assembly 400 that is stationary, it should be appreciated that various features or elements of the various embodiments and examples discussed herein are applicable to some moving heating assemblies as well. In one example, the heating assembly can be a part of a roller movable with the roller. Thus, some of the heating element assembly structures could move with the roller. In another example, some of the heating element tensioning mechanisms could apply to moving heating assemblies. In other embodiments, the heating element assembly 410 may move with the drive elements, be stationary relative to the moving drive elements, move relative to the movement of the compression elements, or move relative to the flexible structure 100. Persons of ordinary skill in the art, based on the disclosure herein, can adapt these features and elements to a variety of other systems, only some of which are disclosed herein in detail.

After being sealed, the first and second plies are cooled, allowing the seal to harden by rolling the sealed first and second plies around a cooling element. The cooling element may act as a heat sink or may provide a sufficient cooling time for the heat to dissipate into the air. In accordance with various embodiments, the cooling element is one or more of the compression elements. In the preferred embodiment, the heating assembly 400 and one or more of the driving elements cooperatively press or pinch the first and second plies of the web together at the first pinch area against the heating assembly to seal the two plies together. The sealing assembly may rely on pressure from the drive element against the heating assembly 400 to sufficiently seal the web layers together. Flexible resilient material of the drive mechanism can allow for the pressure to be well controlled.

In accordance with various embodiments, the inflation and sealing assembly 132 may include one or more covers (e.g. 181 and 182) over the inflation and sealing assembly 132. The covers (e.g. 181 and 182) can be operable to redirect the web after the web exits the inflation region and/or the sealing region. For example, the covers include a deflection surface 183 that contacts the flexible material 100 as it exits inflation and sealing regions and the covers can also aid in separating the flexible material 100 from the other components within the inflation and sealing regions, thereby redirecting the flexible material 100 in any desired direction. By orienting the housing 141 in various different ways the covers can direct and dispense the flexible material 100 in different directions. For example, setting the device 50 on base 700*a* may direct the web down due to the position of covers 181 and 182 but flipping the device 50 onto top 700*c* as the support would direct the web up due to the new relative position of the covers.

In accordance with various embodiments, the inflation and sealing assembly 132 may further include a cutting assembly to cut the flexible structure. Preferably, the cutting member is sufficient to cut the flexible structure 100 as it is moved past the edge along the material path "E". More particularly, the cutting assembly may cut the first and second plies between the first longitudinal edge of the web and the chambers.

It should be appreciated that these examples should not be limiting. For example, the cushion forming machines disclosed herein have all been ones in which a flexible plastic web is inflated. However, the concepts disclosed herein could apply to other systems as well such as paper conversion systems wherein the housings can be placed in different orientations and support is provided to cantilevered spindles as discussed herein. Foram in bag systems may likewise be able to utilize the concepts disclosed herein. A person of ordinary skill in the art can apply the concepts herein to numerous other systems in light of the disclosure provided herein. Similarly other types of sealing mechanisms, drive mechanisms, inflation mechanisms, and other structures, assemblies and mechanisms may be configured in accordance with any known embodiments or developed embodiments and can benefit from the disclosure herein as a person of ordinary skill in the art could apply based on the disclosure herein. For example, systems with similar and different components, and/or material such as those disclosed in U.S. Pat. No. 8,128,770 and U.S. Patent Pub. No. 2013/0053767 may also utilize the various housings, orientations, and stands as variously discussed herein. U.S. Pat. No. 8,128,770 and Patent Pub. No. 2013/0053767 are hereby incorporated by reference in their entirety and it is understood that a person of ordinary skill in the art can adapt the systems described in light of the disclosure provided herein.

Any and all references specifically identified in the specification of the present application are expressly incorporated herein in their entirety by reference thereto. The term "about," as used herein, should generally be understood to refer to both the corresponding number and a range of numbers. Moreover, all numerical ranges herein should be understood to include each whole integer within the range.

Having described several embodiments herein, it will be recognized by those skilled in the art that various modifications, alternative constructions, and equivalents may be used. The various examples and embodiments may be employed separately or they may be mixed and matched in combination to form any iteration of the alternatives. Additionally, a number of well-known processes and elements have not been described in order to avoid unnecessarily obscuring the focus of the present disclosure. Accordingly, the above description should not be taken as limiting the scope of the invention. Those skilled in the art will appreciate that the presently disclosed embodiments teach by way of example and not by limitation. Therefore, the matter contained in the above description or shown in the accompanying drawings should be interpreted as illustrative and not in a limiting sense. The following claims are intended to cover all generic and specific features described herein, as well as all statements of the scope of the present method and system, which, as a matter of language, might be said to fall there between.

What is claimed is:

1. A protective packaging formation device for sealing a flexible web, the device comprising:

a housing having a plurality of housing supports disposed to collectively define a plurality of support plane areas each operable for separate contact with an underlying surface, such that the housing is positionable in a plurality of different dispensing orientations by placing the housing on the different housing supports;

a web support depending from the housing and having a first end positioned distally from the housing and a second end positioned proximal to the housing such that the web support supports a supply of a flexible web in a position extending from the housing beyond the housing support; and an adjustable stand connected to the first end of the web support and extending down to form an additional point in at least one of the plurality of support plane areas such that the stand operably limits the tilting of the housing in the direction in which the web support extends from the housing.

2. The protective packaging formation device of claim 1, wherein the flexible web support is positioned in a cantilevered position relative to the housing when the housing is positioned in at least one of the plurality of dispensing orientations and in the cantilevered position the weight of the web positioned on the web support tends to tilt the housing in the direction that the web support extends from the housing.

3. The protective packaging formation device of claim 2, wherein the stand includes a foot bracket that extends from the housing in generally the same direction as the web support with at least one support on the distal end of the stand and the at least one support is generally planer with at least one of the plurality of housing supports.

4. The protective packaging formation device of claim 3, wherein the stand extends from the housing between the web support and a base of the housing and the stand is a single beam that is smaller in cross-section than the web support and the web supported thereon.

5. The protective packaging formation device of claim 4, wherein the stand extends at least from the web support to one of the plurality of support plane areas.

6. The protective packaging formation device of claim 3, wherein the web support includes a spindle and the stand is a spindle support located on the spindle end located distally from the housing.

7. The protective packaging formation device of claim 6, wherein at least one of the web support or the stand includes a bearing that allows movement between web support and the stand.

8. The protective packaging formation device of claim 7, wherein the spindle support is adjustable about an axis such that the spindle support is configurable to extend to different support plane areas.

9. The protective packaging formation device of claim 8, wherein the spindle support is rotatable relative to the spindle.

10. The protective packaging formation device of claim 9, wherein the rotation is centered on the axis of rotation of the spindle.

11. The protective packaging formation device of claim 7, wherein the spindle support is a beam that extends from the first end of the spindle.

12. The protective packaging formation device of claim 7, wherein the beam includes at least one bend that defines an elongated foot that reaches at least one support plane area.

13. The protective packaging formation device of claim 2, wherein one or more of the supports includes one or more mounting features for mounting the housing in a vertical position.

14. The protective packaging formation device of claim 13, wherein the mounting features are apertures that are configured to receive a fastener and mount the housing to a vertical support.

15. The protective packaging formation device of claim 14, wherein the one or more mounting features includes at least two mounting features spaced far enough apart to limit the tendency of the housing to tilt in the direction of the spindle due to the cantilevered position of the spindle and its weight.

16. The protective packaging formation device of claim 1, wherein the housing includes end walls that form elongated contact surfaces on a base of the housing and a top of the housing, with each of the two elongated surfaces defining two supports of the plurality of supports.

17. The protective packaging formation device of claim 16, wherein the end walls also form elongated contact surfaces on the back of the housing as another support of the plurality of supports.

18. The protective packaging formation device of claim 17, wherein the end walls also form elongated contact surfaces along the front of the housing at the base and the top.

19. The protective packaging formation device of claim 18, wherein a front wall and the end walls of the housing are formed of a single c-shaped sheet of material that forms the bottom support at the front and end walls, top support at the top and end walls, and a back support on the back of the housing where the legs of the c-shaped sheet of material terminate in a support plane area.

20. The protective packaging formation device of claim 18, wherein the spindle is located at a halfway point between the top support and the bottom support such that the rotatable spindle support terminates at each of these respective support plane areas and provides substantially the same support to the spindle at each of these support surfaces.

21. A protective packaging formation device for sealing a flexible web, the device comprising:

a repositionable housing having a plurality of housing supports disposed to collectively define a plurality of different support plane areas for contact with an underlying surface, such that the housing is positionable in a plurality of different dispensing orientations resulting from placing the housing on the plurality of different support plane areas; and a web support depending from the housing, the web support having a first end positioned distally from the housing and a second end positioned proximal to the housing such that the web support supports a supply of a flexible web in a position extending from the housing beyond the housing support, wherein the plurality of housing supports allow the web to be dispensed from a driving mechanism on the housing in different positions depending on which of the plurality of different dispensing orientations the housing is positioned in.

22. The protective packaging formation of claim 21, wherein the housing includes end walls that form elongated contact surfaces on a base of the housing and a top of the housing, with each of the two elongated surfaces defining two supports of the plurality of supports.

23. The protective packaging formation of claim 22, wherein the end walls also form elongated contact surfaces on the back of the housing as another support of the plurality of supports.

24. The protective packaging formation of claim 23, wherein the end walls also form elongated contact surfaces along the front of the housing at the base and the top.

* * * * *